US011815340B2

(12) United States Patent
Osten

(10) Patent No.: US 11,815,340 B2
(45) Date of Patent: Nov. 14, 2023

(54) PORTABLE BALLISTIC-RESISTANT DEVICE

(71) Applicant: IMPACT GUARD LLC, Leetsdale, PA (US)

(72) Inventor: Samuel J. Osten, Pittsburgh, PA (US)

(73) Assignee: Impact Guard LLC, Leetsdale, PA (US)

( * ) Notice: Subject to any disclaimer, the term of this patent is extended or adjusted under 35 U.S.C. 154(b) by 0 days.

(21) Appl. No.: 17/581,062

(22) Filed: Jan. 21, 2022

(65) Prior Publication Data

US 2023/0235995 A1 Jul. 27, 2023

(51) Int. Cl.

| | |
|---|---|
| ***F41H 5/24*** | (2006.01) |
| ***F41H 5/06*** | (2006.01) |
| ***F41H 5/04*** | (2006.01) |
| ***F41H 5/013*** | (2006.01) |

(52) U.S. Cl.

CPC ..... *F41H 5/24* (2013.01); *F41H 5/013* (2013.01); *F41H 5/0485* (2013.01); *F41H 5/06* (2013.01)

(58) Field of Classification Search

CPC ..... F41H 5/24; F41H 5/013; F41H 5/0485; F41H 5/06

See application file for complete search history.

(56) References Cited

U.S. PATENT DOCUMENTS 3,398,406 A * 8/1968 Waterbury ..... B63C 9/087 441/103
3,491,847 A * 1/1970 Abbott ..... B65D 85/68 102/303
3,562,810 A * 2/1971 Davis ..... F41H 5/0485 2/2.5
4,241,457 A * 12/1980 Klein ..... F41H 5/0464 2/2.5
4,479,994 A * 10/1984 Berg ..... F41H 3/02 428/314.4
4,949,490 A * 8/1990 Miller ..... G09F 15/0068 40/605
5,097,885 A * 3/1992 Kitagawa ..... E06B 9/24 160/84.01
5,377,577 A * 1/1995 Bounkong ..... F41H 5/08 2/2.5

(Continued)

FOREIGN PATENT DOCUMENTS

WO 2009035637 3/2009

OTHER PUBLICATIONS http://www.betafenceusa.com/Bullet-Resistant-Fence, retrieved on Jun. 27, 2016, 1 page.

*Primary Examiner* — Joshua E Freeman

(74) *Attorney, Agent, or Firm* — Nelson Mullins Riley & Scarborough LLP

(57) ABSTRACT

A ballistic-resistant barrier assembly including an elongated barrier having a vertical portion including a substantially horizontal elongated top edge, and a ballistic-resistant device having a first ballistic-resistant panel including an elongated top edge, and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a vertical orientation adjacent the vertical portion of the barrier.

18 Claims, 5 Drawing Sheets

(56) References Cited

U.S. PATENT DOCUMENTS 5,655,585 A * 8/1997 Fry ..... E06B 9/13 160/DIG. 7
5,756,922 A * 5/1998 Fuller ..... F41H 5/06 89/36.02
5,939,658 A * 8/1999 Muller ..... F41H 5/08 89/36.02
6,161,462 A * 12/2000 Michaelson ..... F41H 5/16 89/36.01
6,581,505 B1 * 6/2003 Levell ..... E06C 1/52 89/36.01
6,622,607 B1 9/2003 Miller et al.
6,807,890 B1 10/2004 Fuqua
6,899,009 B2 * 5/2005 Christiansen ..... E06B 9/00 89/36.02
7,380,379 B2 6/2008 Venegas, Jr.
7,424,844 B2 9/2008 Carter
7,494,112 B2 2/2009 Fromm
D599,488 S * 9/2009 Christensen ..... D25/48.5
7,789,585 B2 * 9/2010 Christensen ..... E01F 13/022 116/63 P
7,891,283 B2 2/2011 Kleniatis
7,980,166 B1 * 7/2011 Fuqua ..... F41H 5/24 86/50
3,001,880 A1 8/2011 White et al.
8,210,088 B1 * 7/2012 Keyfauver ..... F41H 5/08 89/918
8,276,499 B1 10/2012 Fuqua et al.
8,919,237 B1 * 12/2014 Hooks ..... F41H 5/013 89/36.01
9,200,872 B1 * 12/2015 Millar ..... F41H 5/0485
11,215,428 B2 * 1/2022 Howell ..... E06B 9/06
11,313,651 B2 * 4/2022 Hadtke ..... F41H 5/08
11,454,475 B2 * 9/2022 Howell ..... F41H 5/08
2002/0104429 A1 * 8/2002 Euler ..... F41H 5/06 89/36.02
2003/0198777 A1 * 10/2003 McIntee ..... B32B 7/09 428/102
2006/0231820 A1 * 10/2006 Bilby ..... E01F 13/022 256/24
2011/0048292 A1 3/2011 Zimmer
2016/0040962 A1 * 2/2016 Rossow ..... F41H 5/0485 89/36.02
2016/0061569 A1 * 3/2016 Fernandez ..... F41H 5/08 89/36.02
2018/0188007 A1 * 7/2018 Freier ..... F41H 5/0485
2019/0234094 A1 * 8/2019 Nead ..... F41H 5/24
2019/0353465 A1 * 11/2019 Muth ..... F41H 5/24
2019/0368842 A1 * 12/2019 Xu ..... F41H 5/06
2021/0080229 A1 * 3/2021 Fisher ..... F41H 5/14

* cited by examiner

PORTABLE BALLISTIC-RESISTANT DEVICE

FIELD OF THE INVENTION

The present invention relates generally to ballistic-resistant protective equipment and, more particularly, to ballistic-resistant devices that may be used in concert with known crowd control barriers to provide protection from airborne objects.

BACKGROUND OF THE INVENTION

The use of barriers, both movable and fixed, is well known for crowd control. For example, as shown in FIGS. 9A, 9B, and 9C, movable barriers such as, but not limited to gate-type, molded plastic, retractable belt stanchions, etc., often prove useful for crowd control where events occur only periodically, such as at parades, political rallies, pedestrian races, etc. Fixed barriers such as, but not limited to, iron fencing, chain link fencing, concrete barricades, etc., are often used where crowd control is required on a continuous basis. However, whether movable or fixed, common barriers often lack the ability to offer protection from airborne projectiles to persons on either side of the barriers due to the open nature of many barriers, as shown in FIGS. 9A, 9B, and 9C. Although such protection may not be necessary each time the barriers are utilized, there can be times where protection from shrapnel due to explosives, projectiles from firearms, and other high velocity airborne objects is desirable.

SUMMARY OF THE INVENTION

One embodiment of the present disclosure provides a ballistic-resistant barrier assembly including an elongated barrier having a vertical portion including a substantially horizontal elongated top edge, and a ballistic-resistant device having a first ballistic-resistant panel including an elongated top edge, and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a vertical orientation adjacent the vertical portion of the barrier.

Another embodiment of the present disclosure provides a ballistic-resistant device for use with a crowd control barrier having an elongated top edge, including a first ballistic-resistant panel having an elongated top edge, and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a vertical orientation on the barrier.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
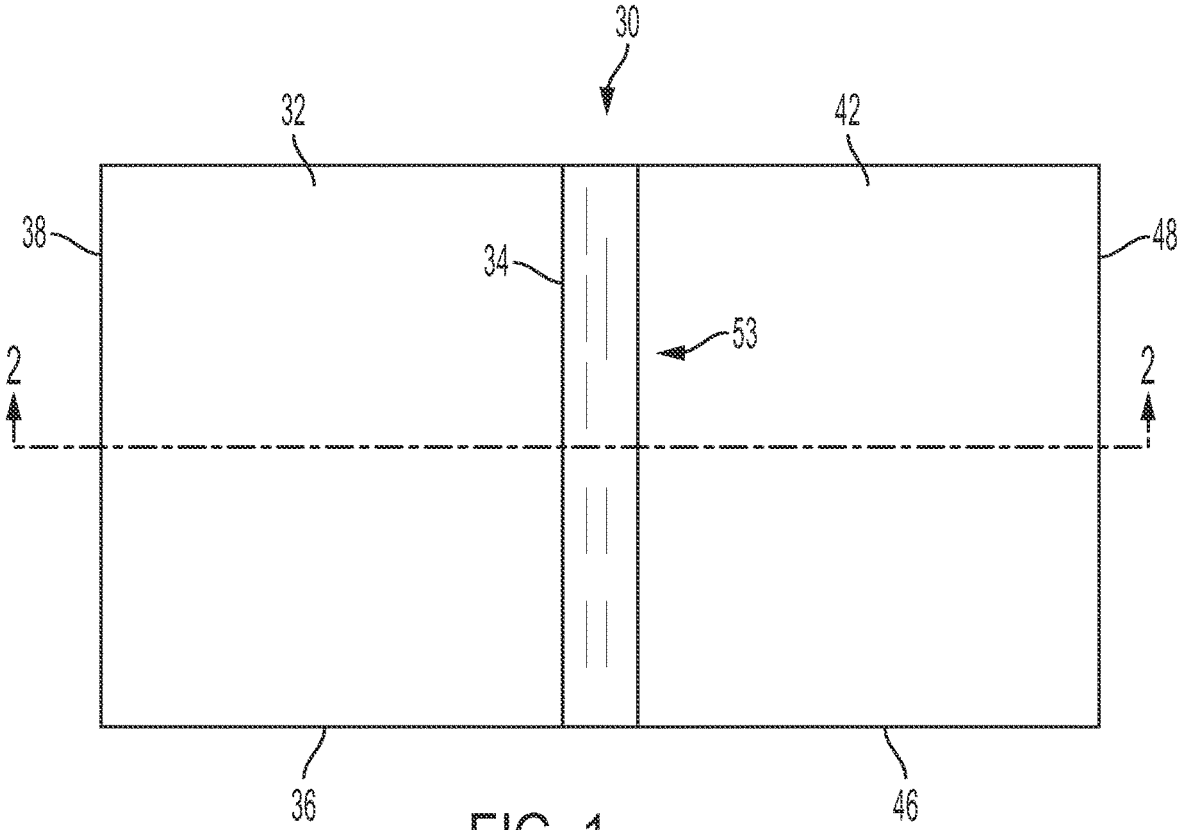
FIG. 1 is a plan view of an embodiment of a portable ballistic-resistant device in accordance with the present disclosure.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of the portable ballistic-resistant assembly, such as but not limited to "vertical," "horizontal," "top," "bottom," "above," or "below," refer to directions and relative positions with respect to the ballistic-resistant assembly's orientation shown in FIGS. 2A and 2B. Thus, for instance, the terms "vertical" and "top" refer to the vertical orientation and relative upper position in the perspective of FIGS. 2A and 2B, and should be understood in that context, even with respect to a ballistic-resistant assembly that may be disposed in a different orientation.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "and" as used in this application and the appended claims should generally be construed to mean "one or more" unless specified otherwise or clear from the context to be directed to a singular form. Throughout the specification and claims, the following terms takes at least the meanings explicitly associated herein, unless the context dictates otherwise. The meanings identified below do not necessarily limit the terms, but merely provide illustrative examples for the terms. The meaning of "a," "and," and "the" may include plural references, and the meaning of "in" may include "in" and "on." The phrase "in one embodiment," as used herein, does not necessarily refer to the same embodiment, although it may.

Figure 2:
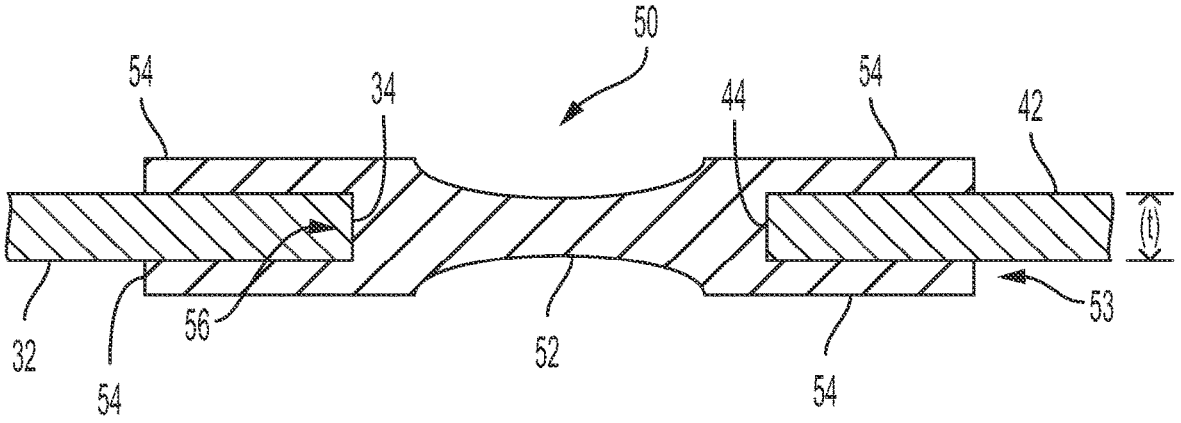
FIG. 2 is a partial cross-section view of the portable ballistic-resistant device shown in FIG. 1, taken along line 2-2.
Figure 9A:
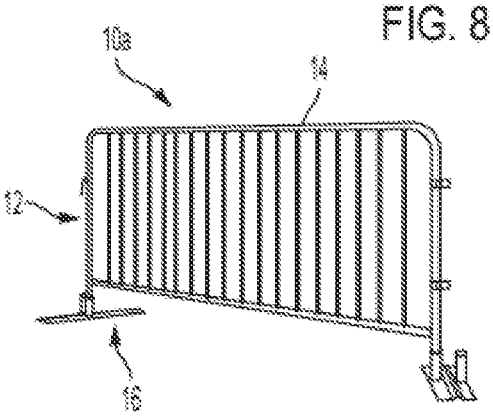
FIGS. 9A, 9B, and 9C are front views of prior art movable crowd barriers.

Referring now to the Figures, an embodiment of a portable ballistic-resistant device 30 in accordance with the present disclosure as shown in FIGS. 1 and 2. As shown, ballistic-resistant device 30 may include a first ballistic-resistant panel 32, a second ballistic-resistant panel 42, and an engagement portion 50 disposed therebetween that flexibly attaches first ballistic-resistant panel 32 to second ballistic-resistant panel 42. As shown, first ballistic-resistant panel 32 includes an elongated top edge 34, an elongated bottom edge 38 that is substantially parallel thereto, and a pair of side edges 36 that extend between the top edge 34 and bottom edge 38, so that first-ballistic resistant panel 32 is substantially rectangular. In the present embodiment, second ballistic-panel 42 is similarly shaped to first ballistic-resistant panel 32 and includes an elongated top edge 44, an elongated bottom edge 48 that is substantially parallel thereto, and a pair of substantially parallel side edges 46 that extend therebetween. Ballistic-resistant device 30 is configured for use with barriers, such as those shown in FIGS. 9A-9C, that are either entirely or partially incapable of being considered ballistic-resistant because they have open passthrough areas and/or areas constructed of materials that are incapable of stopping projectiles meeting at least the level I standard of Underwriter Laboratories (UL) § 752.

First ballistic-resistant panel 32 and second ballistic-resistant panel 42 are preferably formed of a material that meets the UL § 752 standards for projectile threat levels I through III, such as, but not limited to, materials as disclosed in U.S. Pat. No. 9,409,607, issued Aug. 9, 2016 to Impact Guard LLC, the entire disclosure of which is incorporated herein by reference, and similar materials. Some example materials are manufactured by Impact Guard LLC, Leetsdale, Pa., and available under product line serial numbers IG4000 and IG6000, respectively, which are comprised of unidirectional fiberglass/polypropylene tapes that are alternatingly stacked at 90° to each other and melt laminated to a solid board. Such materials meet even higher UL § 752 threat level standards, and may be used in alternate embodiments. As well, first ballistic-resistant panel 32 and second ballistic-resistant panel 42 are preferably formed of a fiber-reinforced thermoplastic composite and, more specifically, a polyolefin thermoplastic composite, that is moldable into a rigid or semi-rigid condition. For example, the fiber-reinforced thermoplastic composite may include multiple layers that are bonded to each other, with each alternating layer including a plurality of unidirectional fibers that is substantially parallel to the pluralities of unidirectional fibers in the adjacent layers. As well, in alternate embodiments, first and second ballistic-resistant panels 32 and 42 may be constructed of a flexible ballistic-resistant material, such as a woven material, that is used independently or, in the alternative, adhered to a semi-rigid or rigid base layer that is moldable.

Figure 3A:
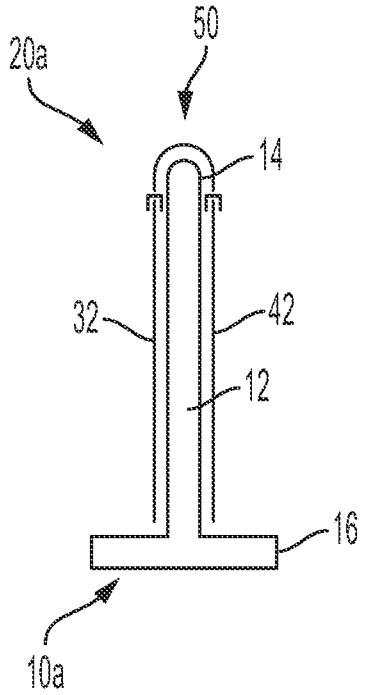
FIGS. 3A and 3B are a side view and a front view, respectively, of the portable ballistic-resistant device shown in FIG. 1 mounted on a portable barrier as shown in FIG. 9A.
Figure 3B:
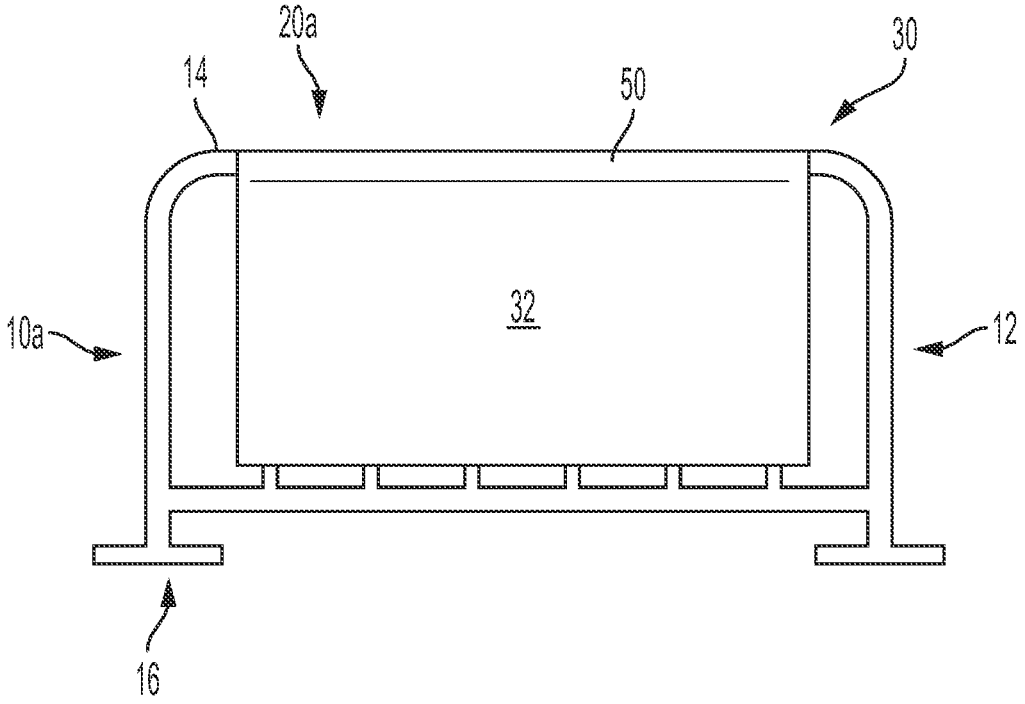

As best seen in FIG. 2, engagement portion 50 flexibly connects first ballistic-resistant panel 32 to second ballistic-resistant panel 42 so that ballistic-resistant device 30 may be utilized with a crowd control barrier 10*a*, as shown in FIGS. 3A and 3B, to provide protection to personnel from airborne projectiles. As shown, engagement portion 50 includes an elongated flexible strap 52 that is substantially the same length as the top edges 34 and 44 of first and second ballistic-resistant panels 32 and 42, as shown in FIG. 1. Each side edge 53 of elongated strap 52 includes a pair of substantially parallel flanges 54 that form an elongated recess 56 therebetween. The distance separating each pair of corresponding flanges 54 is substantially the same as the thickness (t) of the ballistic-resistant panel 32, 42 whose corresponding top edge 34, 44 is received therein. Each elongated top edge 34 and 44 of first ballistic-resistant panel 32 and second ballistic-resistant panel 42, respectively, is secured within the elongated groove 56 of flexible strap 52 by means an adhesive and/or a plurality of fasteners, such as, but not limited to, rivets, nuts and bolts, etc., that extend through a corresponding pair of flanges 54 and the material of the corresponding ballistic-resistant panel received therebetween. As shown, engagement portion 50 may be formed of a flexible woven or knitted fiber webbing material that is co-molded within a flexible plastic material. Engagement portion 50 may be formed of any flexible material that is suitable for being affixed to first and second ballistic-resistant panels 32 and 42, and need not be co-molded within a flexible plastic material.

As best seen in FIGS. 3A and 3B, the dimensions and flexibility of engagement portion 50 are such that engagement portion 50 of ballistic-resistant device 30 is positionably adjacent a horizontal top edge of a corresponding crowd control barrier 10*a* (FIG. 9A) such that first ballistic-resistant panel 32 and second ballistic-resistant panel 42 are disposed substantially vertically with regard to a vertical portion 12 of crowd control barrier 10*a*, as well as substantially parallel to each other. As shown, ballistic-resistant panels 32 and 42 do not cover the entirety of the vertical portion 14 of the crowd control barrier 10*a*. However, ballistic-resistant panels 32 and 42 may be sized such that they overlap the horizontal edges 36 and 46 of ballistic-resistant devices 30 or adjacent crowd control barriers 10*a* overlap, thereby minimizing potential passthrough areas. In alternate embodiments, multiple engagement portions 50 may be disposed along the lengths of elongated top edges 34 and 44 rather than a single, continuous engagement portion 50 as shown.

Figure 4A:
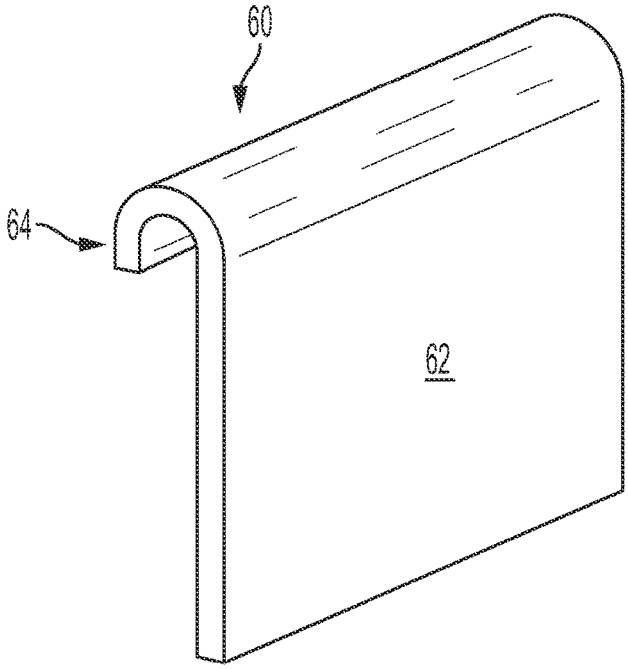
FIGS. 4A and 4B are perspective views of alternate embodiments of portable ballistic-resistant devices in accordance with the present disclosure.
Figure 5:
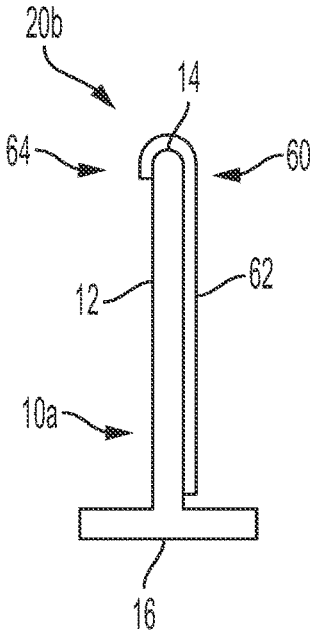
FIG. 5 is a schematic side view of the portable ballistic-resistant device shown in FIG. 4 mounted on a portable barrier as shown in FIG. 9A.

Referring now to FIG. 4A, an alternate embodiment of a ballistic-resistant device 60 includes a single ballistic-resistant panel 62 with an elongated top edge that is molded into an engagement portion in the form of a curved flange 64. As shown, in FIG. 5, curved flange 64 is configured to receive horizontal top edge 14 of a corresponding crowd control barrier 10*a* therein so that ballistic-resistant panel 62 is vertically disposed adjacent vertical portion 12 of the barrier. As shown, curved flange 64 allow ballistic-resistant panel 62 to be disposed on either side of vertical portion 12 of the corresponding barrier, dependent upon the side of the barrier from which airborne projectiles can be expected.

Figure 4B:
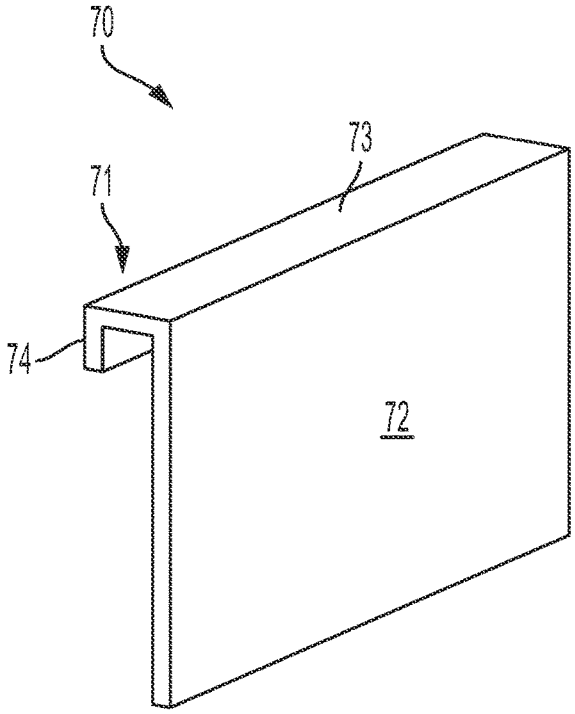

Referring additionally to FIG. 4B, yet another embodiment of a ballistic-resistant device 70 includes a ballistic-resistant panel 72 having an engagement portion in the form of an L-shaped flange 71 formed by a top wall 73 that is substantially perpendicular to ballistic-resistant panel 72, and a side wall 74 extending downwardly therefrom that is substantially parallel to ballistic-resistant panel 72.

Figure 6:
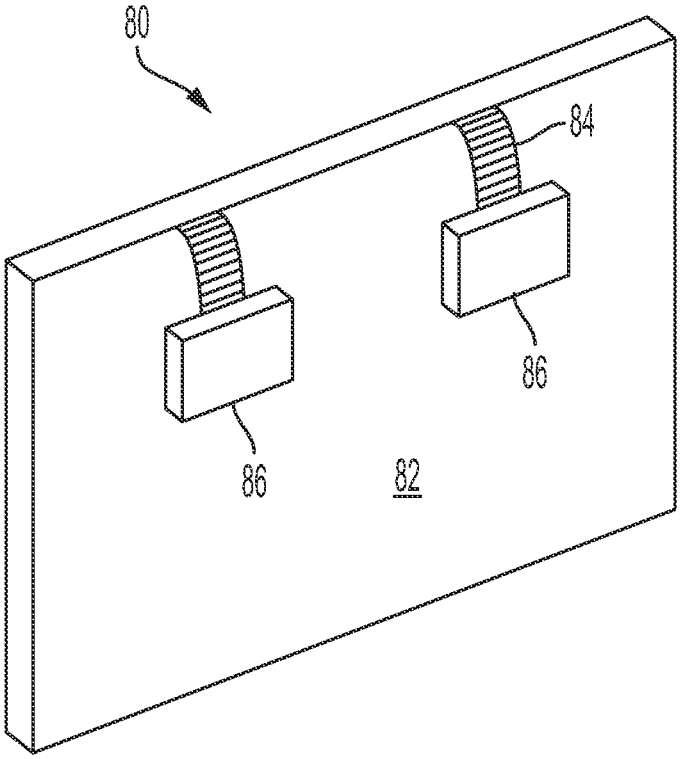
FIG. 6 is a perspective view of an alternate embodiment of a portable ballistic-resistant device in accordance with the present disclosure.
Figure 7:
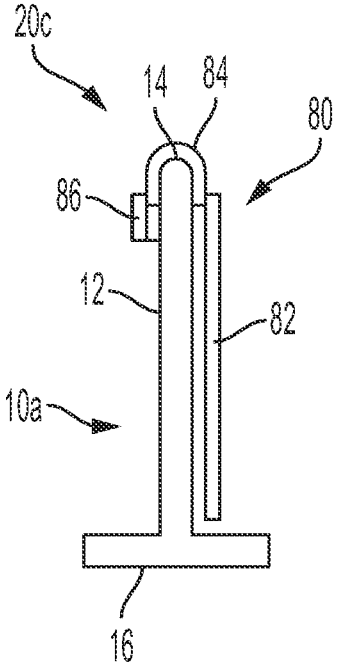
FIG. 7 is a schematic side view of the portable ballistic-resistant device shown in FIG. 6 mounted on a portable barrier as shown in FIG. 9A.

Referring now to FIG. 6, an alternate embodiment of a ballistic-resistant device 80 includes a single ballistic-resistant panel 82 that is substantially rectangular in shape, having one or more counterweights 86 affixed to the top edge of the ballistic-resistant panel 82 by flexible straps 84. As shown, a pair of counterweights 86 is affixed by individual straps 84. Alternately, a single elongated counterweight may be affixed by either a single elongated strap or multiple individual straps. Referring additionally to FIG. 7, the counterweights 86 allow single ballistic-resistant panel 82 to be positioned vertically on the side of the barrier 10*a* from which airborne projectiles may be expected.

Figure 8:
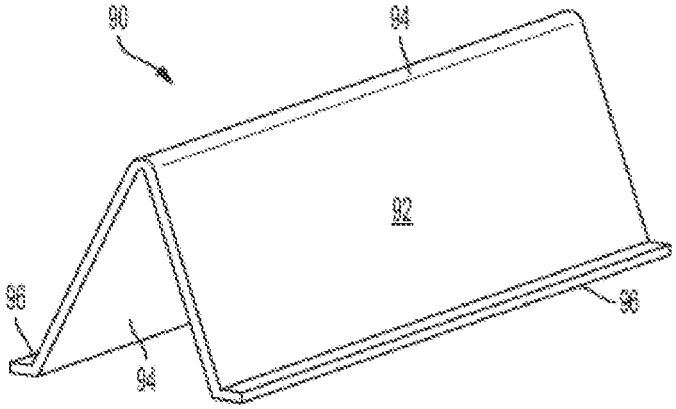
FIG. 8 is a perspective view of an alternate embodiment of a portable ballistic-resistant device in accordance with the present disclosure.

Referring now to FIG. 8, an alternate embodiment of a ballistic-resistant device 90 includes a first ballistic-resistant panel 92 and a second ballistic-resistant panel 94 whose top edges are joined at an apex 94, so that an acute angle is formed therebetween. As shown, ballistic-resistant device 90 is formed of a moldable ballistic-resistant material so that ballistic-resistant device 90 is substantially rigid, thereby allowing it to be used independently of the corresponding crowd control barrier. Preferably, an elongated base flange 96 extends along the bottom edge of both first and second ballistic-resistant panels 92 and 94, to lend improved stability to the stand-alone ballistic-resistant device 90. Elongated flanges 96 may also include apertures therein to facilitate securing ballistic-resistant device 90 in place with ground spikes (not shown) or similar devices.

Figure 9B:
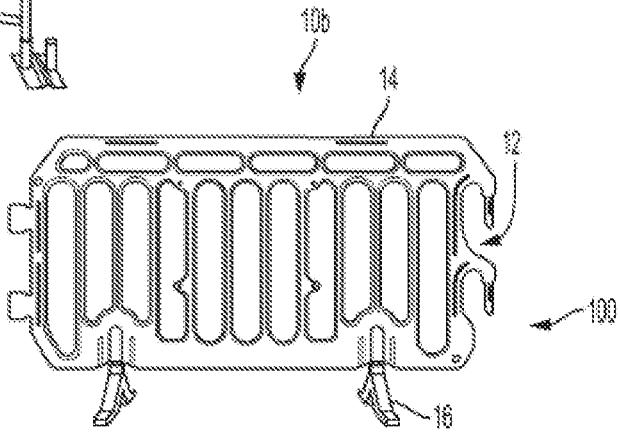
Figure 9C:
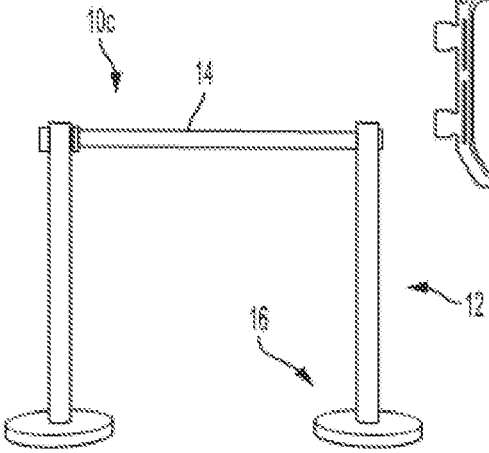

In addition to a gate-style crowd control barrier 10*a* as previously discussed, embodiments of ballistic-resistant devices in accordance with the present disclosure may also be utilized with molded plastic barriers 10*b*, as shown in FIG. 9B, retractable belt style stanchion barriers 10*c*, as shown in FIG. 9C, etc. Moreover, ballistic-resistant barriers in accordance with the present disclosure may also be utilized with permanently installed fencing such as, but not limited to, wrought iron fencing, chain-link fencing, etc.

While one or more preferred embodiments of the invention are described above, it should be appreciated by those skilled in the art that various modifications and variations can be made in the present invention without departing from the scope and spirit thereof. For example, alternate embodiments of ballistic-resistant assemblies in accordance with the present disclosure may have fewer, or more, ballistic-resistant panels than the number of the discussed embodiments. It is intended that the present invention cover such modifications and variations as come within the scope and spirit of the appended claims and their equivalents.

The invention claimed is:

1. A ballistic-resistant barrier assembly comprising:

an elongated barrier having a substantially vertical portion including a substantially horizontal elongated top edge; and a ballistic-resistant device comprising:

a first ballistic-resistant panel including an elongated top edge;

a second ballistic-resistant panel including an elongated top edge; and an engagement portion affixed to the elongated top edge of the first ballistic-resistant panel and to the elongated top edge of the second ballistic-resistant panel, wherein the engagement portion of the ballistic-resistant device is disposed adjacent the elongated top edge of the barrier so that the first ballistic-resistant panel is disposed in a substantially vertical orientation adjacent a first side of the substantially vertical portion of the barrier and so that the second ballistic-resistant panel is disposed in a substantially vertical orientation adjacent a second side of the substantially vertical portion of the barrier opposite the first side of the substantially vertical portion of the barrier.

2. The barrier assembly of claim 1, wherein the engagement portion further comprises an elongated flexible strap including a pair of opposed side edges, wherein the side edges of the flexible strap are respectively affixed to the elongated top edge of the first ballistic-resistant panel and the elongated top edge of the second ballistic-resistant panel.

3. The barrier assembly of claim 2, wherein the side edges of the flexible strap are respectively affixed to the top edge of the first ballistic-resistant panel and the top edge of the second ballistic-resistant panel by one of stitching, adhesives, and fasteners.

4. The barrier assembly of claim 2, wherein each side edge of the elongated flexible strap defines an elongated groove, and the elongated top edge of each of the first ballistic-resistant panel and the second ballistic-resistant panel is received in a respective one of the elongated grooves.

5. The barrier assembly of claim 1, wherein the first ballistic-resistant panel is comprised of a moldable ballistic-resistant material.

6. The barrier assembly of claim 1, wherein the engagement portion of the ballistic-resistant device comprises a flexible strap having a first end and a second end, and a counterweight, wherein the first end of the flexible strap is affixed to the top edge of the first ballistic-resistant panel and the second end of the flexible strap is affixed to the counterweight.

7. The barrier assembly of claim 1, wherein each of the first ballistic-resistant panel and the second ballistic-resistant panel is comprised of a flexible ballistic-resistant material.

8. A ballistic-resistant barrier assembly, comprising:

an elongated barrier having a substantially vertical portion including a substantially horizontal elongated top edge; and a ballistic-resistant device comprising a first ballistic-resistant panel including an elongated top edge; and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a substantially vertical orientation adjacent the substantially vertical portion of the barrier, wherein the first ballistic-resistant panel is comprised of a fiber-reinforced thermoplastic composite panel comprising a first layer having a first plurality of unidirectional fibers embedded therein, the fibers being substantially parallel to a first fiber axis, and a second layer having a plurality of unidirectional fibers embedded therein, the fibers being substantially parallel to a second fiber axis, the first layer being bonded to the second layer so that the first fiber axis is substantially perpendicular to the second fiber axis.

9. A ballistic-resistant barrier assembly, comprising:

an elongated barrier having a substantially vertical portion including a substantially horizontal elongated top edge; and a ballistic-resistant device comprising a first ballistic-resistant panel including an elongated top edge, and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a substantially vertical orientation adjacent the substantially vertical portion of the barrier, and wherein the engagement portion of the first ballistic-resistant device is an elongated flange adjacent the top edge of the first ballistic-resistant panel.

10. The barrier assembly of claim 9, wherein the elongated flange of the ballistic-resistant device has a cross-section that is one of curved and L-shaped.

11. A ballistic-resistant barrier assembly, comprising:

an elongated barrier having a substantially vertical portion including a substantially horizontal elongated top edge; and a ballistic-resistant device comprising a first ballistic-resistant panel including an elongated top edge, and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a substantially vertical orientation adjacent the substantially vertical portion of the barrier, wherein the first ballistic-resistant panel is comprised of a flexible ballistic-resistant material, and wherein the first ballistic-resistant panel further comprises a moldable substrate panel, and the flexible ballistic-resistant material is affixed thereto.

12. A ballistic-resistant device for use with a crowd control barrier having an elongated top edge, comprising:

a first ballistic-resistant panel including an elongated top edge;

a second ballistic-resistant panel including an elongated top edge; and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a substantially vertical orientation on the barrier and comprises an elongated flexible strap including a pair of opposed side edges, and wherein each side of the flexible strap is affixed to a said top edge of a respective one of the first ballistic-resistant panel and the second ballistic-resistant panel.

13. The ballistic-resistant device of claim 12, wherein the side edges of the flexible strap are respectively affixed to the top sedge of the first ballistic-resistant panel and the second ballistic-resistant panel by one of stitching, adhesives, and fasteners.

14. The ballistic-resistant device of claim 12, wherein each side edge of the flexible elongated strap defines an elongated groove, and the top edge of each of the first ballistic-resistant panel and the second ballistic-resistant panel is received in a respective one of the elongated grooves.

15. The ballistic-resistant device of claim 12, wherein the first ballistic-resistant panel is comprised of a moldable ballistic-resistant material.

16. A ballistic-resistant device for use with a crowd control barrier having an elongated top edge, comprising:

a first ballistic-resistant panel including an elongated top edge; and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a vertical orientation on the barrier, and wherein the first ballistic-resistant panel is a fiber-reinforced thermoplastic composite panel comprising a first layer having a first plurality of unidirectional fibers embedded therein, the fibers being substantially parallel to a first fiber axis, and a second layer having a plurality of unidirectional fibers embedded therein, the fibers being substantially parallel to a second fiber axis, the first layer being bonded to the second layer so that the first fiber axis is substantially perpendicular to the second fiber axis.

17. A ballistic-resistant device for use with a crowd control barrier having an elongated top edge, comprising:

a first ballistic-resistant panel including an elongated top edge; and an engagement portion affixed to the elongated top edge of the first ballistic-resistant panel, wherein the engagement portion of the ballistic-resistant device is disposed adjacent the elongated top edge of the barrier so that the first ballistic-resistant panel is disposed in a substantially vertical orientation on the barrier, and wherein the engagement portion of the first ballistic-resistant device is an elongated flange adjacent the top edge of the first ballistic-resistant panel.

18. The ballistic-resistant device of claim 17, wherein the elongated flange of the ballistic-resistant device has a cross-section that is one of curved and L-shaped.

* * * * *